US006023872A

United States Patent [19]

Falkenstein, Sr.

[11] Patent Number: 6,023,872

[45] Date of Patent: Feb. 15, 2000

[54] PROMOTIONAL BANNER HAVING RAISED, THREE-DIMENSIONAL AREAS

[76] Inventor: Albert J. Falkenstein, Sr., 3201 Cormany Rd., Akron, Ohio 44319

[21] Appl. No.: 08/905,321

[22] Filed: Aug. 4, 1997

[51] Int. Cl.[7] ..... G09F 3/00

[52] U.S. Cl. ..... 40/800; 40/538

[58] Field of Search ..... 40/800, 538, 604

[56] References Cited

U.S. PATENT DOCUMENTS

| | | | |
|---|---|---|---|
| 3,758,358 | 9/1973 | Kuroda | 40/800 X |
| 3,763,584 | 10/1973 | Falkenstein . | |
| 4,378,391 | 3/1983 | Allen . | |
| 4,409,277 | 10/1983 | Michel . | |
| 4,841,651 | 6/1989 | Conner . | |
| 5,001,853 | 3/1991 | Odien | 40/800 X |

*Primary Examiner*—Cassandra H. Davis
*Attorney, Agent, or Firm*—Reese Taylor

[57] ABSTRACT

A promotional banner (10) includes a substantially planar, flexible base sheet (12) that defines a base plane (24). The base sheet (12) supports printing (18,20) that conveys information to the target audience. The banner (10) includes a raised area (22) that may be in any selected shape. The raised area (22) projects outwardly from the base plane (24) such that it provides the banner (10) with a three-dimensional quality. The raised area (22) is formed by vacuum-forming the base sheet (12) over a mold in the shape of the raised area (22). The raised area (22) has a generally curved cross-section terminating in edges (26,28) that are coplanar with the base plane (24). The raised area (22) may also define a common edge (32) that may be either coplanar with the base plane (24) or somewhat above the base plane (24).

8 Claims, 2 Drawing Sheets

PROMOTIONAL BANNER HAVING RAISED, THREE-DIMENSIONAL AREAS

RELATED PATENT APPLICATIONS

None.

FIELD OF THE INVENTION

The present invention is related to flexible plastic advertising or promotional banners. More specifically, the present invention relates to a flexible plastic banner having an area that is raised in a predetermined shape such that it remains permanently raised and is self-sustaining to give the banner a three-dimensional quality.

BACKGROUND OF THE INVENTION

A common manner of advertising or promoting a product, service or entity is to use a display banner that depicts a representation of the product or service or simply names the entity providing the product or service. Such banners are most typically used outdoors for temporary advertising at events such as festivals, sporting events, or concerts.

These banners are typically fabricated from a flexible but durable plastic material that is substantially weatherproof. The banners are flexible enough to allow them to be rolled or folded for storage or transportation. The banners usually only employ two-dimensional artwork or information, such as silkscreened lettering or other graphic material. Thus, it has been known in the art to "dress up" a banner with balloons or ribbons or help draw the target audience's attention. Such additional dressings add a three-dimensional quality to the banner that helps draw the target audience's eye. Such additional dressings are, however, a burden to the person hanging the banner for he must obtain the additional materials and take the time to install them. It is thus desirable to provide an advertising or promotional banner having an intregally-formed, three-dimensional raised area projecting outwardly from the banner.

SUMMARY OF THE INVENTION

It is thus an object of the present invention to provide an advertising or promotional banner having an intregally-formed, upwardly-projecting raised area that is selectively formed in the banner material.

Another object of the present invention is to provide a banner, as above, that is flexible such that it may be folded or rolled for storage or transport.

A further object of the present invention is to provide a banner, as above, having a raised, three-dimensional area that may be selectively formed in a predetermined shape to match the shape of an article or lettering appearing on the banner so as to give the article or lettering a three-dimensional appearance.

It is still another object of the present invention to provide a method for forming a banner having a raised area.

To that end, it has been found that a banner, according to the present invention, may include a substantially planar, flexible base sheet having at least one raised area projecting outwardly from the base sheet.

A method for forming a banner, according to the present invention, generally includes the steps of providing a substantially planar, flexible base sheet, printing graphics on the base sheet, selecting an area to be raised, and vacuum-forming the selected area to profile the selected area.

Accordingly, an advertising banner of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figures 1, 2:
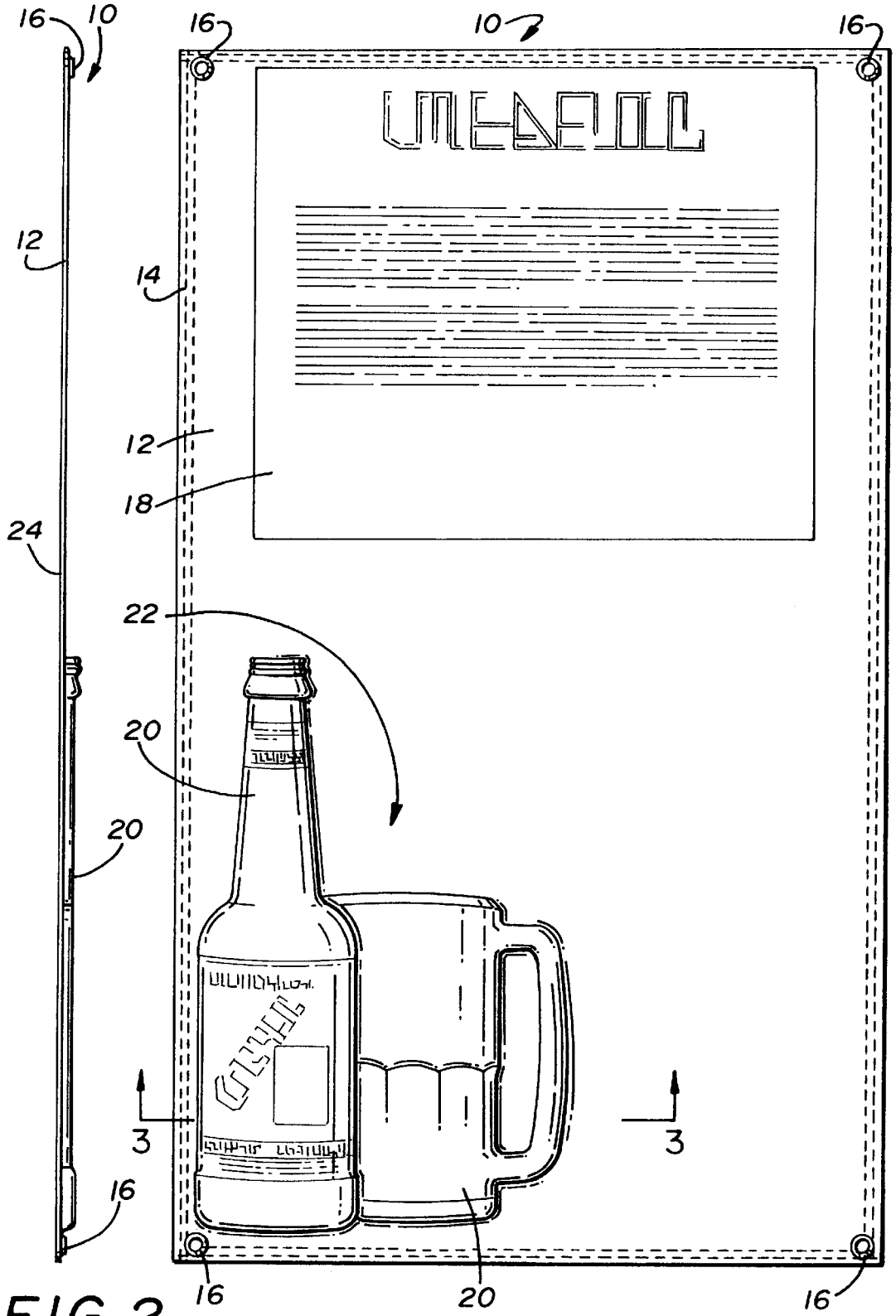
FIG. 1 is a front elevational view of a banner made in accordance with the concepts of the present invention.
FIG. 2 is a side elevational view of the banner.

A banner made in accordance with the concepts of the present invention is indicated generally by the numeral 10 in the accompanying drawings. The banner 10 includes a substantially planar, flexible base sheet, indicated generally by the numeral 12. The base sheet 12 may be provided in numerous sizes to meet the applications desired by the end user. A typical banner 10 may be on the order of over three feet wide and over six feet long so that the information it presents can be seen from relatively long distances. The base sheet 12 is designed to be substantially weatherproof and, to that end, it is typically fabricated from a plastic material. For example, the base sheet 12 may be fabricated from polyethylene, but it is understood that other flexible plastics, such as polyvinyls and vinyls, will also function within the concepts of the present invention. The base sheet 12 is typically bound about its edges by appropriate stitches 14 or taping (not shown) to prevent the sheet from tearing or fraying. Grommets 16 are typically provided in the base sheet 12 so that the banner 10 may be hung by appropriate hangers or by cord, rope or the like.

The base sheet 12 is imprinted with promotional graphics that may be lettering, as indicated generally by the numeral 18, or representations of a product, as indicated generally by the numeral 20, or a combination of both. Such graphics may be added to the base sheet 12 by any one of the numerous printing methods known in the art. Examples of such methods are silkscreening, offset lithography, flexographic and digital ink jet printing.

The base sheet 12 is also provided with a raised area, indicated generally by the numeral 22, that projects outwardly from the base sheet 12 to give the banner 10 a three-dimensional quality. The raised area 22 may be formed in any desired shape, such as the mug and bottle depicted in the figures. The raised area 22 may be formed to provide the advertised product 20 with a raised appearance or may be formed to provide the lettering 18 with a raised appearance.

Figure 3:
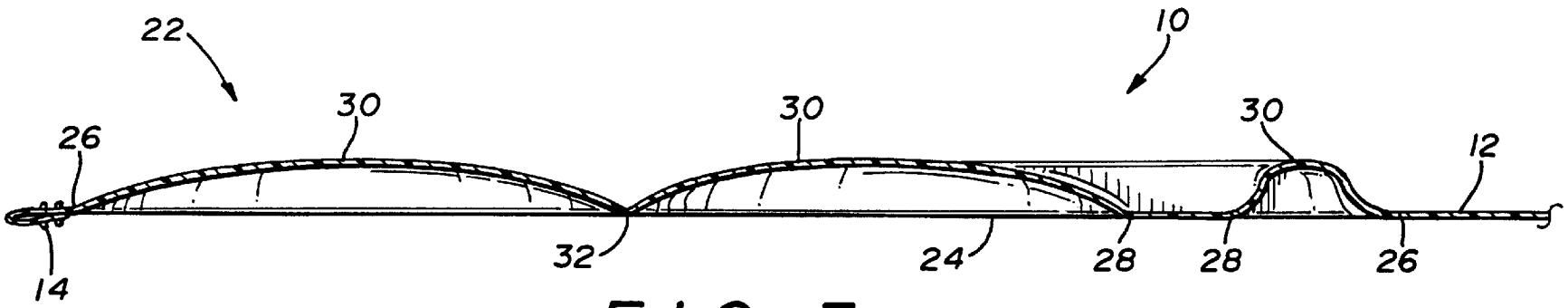
FIG. 3 is a sectional view taken substantially along line 3—3 of FIG. 1.

As can be perhaps best seen in FIG. 3, the raised area 22 projects upwardly from a base plane 24 that is defined by the base sheet 12. The raised area 22 of the present example defines an outer edge 26 and an inner edge 28 at the locations where the raised area 22 joins the base plane 24. The raised area 22 is substantially curved in cross-section such that it projects upwardly away from the edges 26,28 until reaching a highest point 30 where the raised area then curves back down toward the base plane 24. As can also be seen in FIG. 3, a common edge 32 may be shared by two images. The common edge 32 may be at the same level as the base plane 24 or may be somewhat above the level of the base plane 24. In other configurations, the raised area 22 may be substantially flat across its width.

The raised area 22 is formed by stretching the selected area outwardly, away from the base sheet 12 by a process such as, for example, vacuum forming. The base sheet 12 is first cut to the desired size and the printing is added to the base sheet by an appropriate method, such as silkscreening, offset lithography, flexographic, and digital ink jet printing. The area to be raised is then selected and a mold is prepared in the shape of the selected area. The shape and height of the mold determines the shape of the raised area 22 and how far outwardly the raised area 22 will project from the base sheet 12. It has been found that the raised area 22 may be formed to project outwardly from the base plane 24 on the order of approximately two inches or more. Once the mold is prepared, the base sheet 12 is clamped over the mold such that the selected area on the base sheet 12 to be raised is fitted over the mold. A vacuum-forming process known to those skilled in the art is then performed such that the area of the base sheet 12 over the mold is stretched to project outwardly from the base sheet 12. The amount of the stretching is not sufficient to cause undesirable distortion of the printing in the raised area 22. As such, the printing on the area to be raised is created proportionally and without distortion. This allows the printing to be easily performed without having to estimate the amount of stretch and attempt to compensate for it by distorting the printing. Although printing proportional graphics may result in the graphics being stretched at the sidewalls of the raised area 22, the amount of distortion is typically not noticeable enough to be undesirable. The base material 12 is then removed from the mold and the raised area 22 is self-sustaining in that it does not collapse or require additional support to maintain its shape. Creating the raised areas by this method provides durable raised areas 22 that maintain their shape even after being rolled or folded for storage or transport.

In general, it is desirable to use a thicker base sheet 12 when the raised area 22 is large, while a thin base sheet 12 may be sufficient for a small raised area 22. It has been found that base sheets on the order of 8–12 mils function with the concepts of the present invention. It is, however, understood that base sheets 12 of other thicknesses will also function.

While a full and complete description of the invention is set forth in accordance with the dictates of the patent statutes, it should be understood that modifications can be resorted to without departing from the spirit hereof or the scope of the appended claims.

What is claimed is:

1. A banner, comprising:

a thin, substantially planar, flexible base sheet fabricated from a stretchable material having an indicia receiving surface having thereon and at least one integral first raised area projecting outwardly from said indicia receiving surface of said base sheet in a predetermined shape; and having indicia thereon said base sheet being fabricated from a material capable of being selectively rolled up on itself and returned to its substantially planar configuration with said raised area; and said raised area being collapsed in the rolled condition and returned to it predetermined shape upon unrolling has been inserted.

2. A banner according to claim 1 wherein said first raised area is curved in cross-section and is formed without distortion of said indicia received on said indicia receiving surface.

3. A banner according to claim 1 further having a second raised area having a predetermined shape and indicia adjacent said first raised area; said first and second raised areas having a common edge; said second raised area being collapsed in the rolled the rolled condition and returned to it predetermined shape upon unrolling.

4. A banner according to claim 3 wherein said base sheet defines a base plane and said common edge between said first and second raised areas is coplanar with said base plane.

5. A banner according to claim 3 wherein said base sheet defines a base plane and said common edge between said first and second raised areas is disposed above said base plane.

6. A banner according to claim 1 wherein the material of said base sheet is polyethylene.

7. A banner according to claim 1 wherein said raised area is self-sustaining.

8. A banner according to claim 1 wherein attachment means are carried by said base sheet adjacent its perimeter.

* * * * *